US009955776B2

(12) United States Patent
Terry

(10) Patent No.: US 9,955,776 B2
(45) Date of Patent: May 1, 2018

(54) RETRACTABLE FITNESS TOWEL AND HOLDER

(71) Applicant: Sandra Gayle Terry, Northridge, CA (US)

(72) Inventor: Sandra Gayle Terry, Northridge, CA (US)

( * ) Notice: Subject to any disclaimer, the term of this patent is extended or adjusted under 35 U.S.C. 154(b) by 75 days.

(21) Appl. No.: 15/236,087

(22) Filed: Aug. 12, 2016

(65) Prior Publication Data

US 2017/0290409 A1 Oct. 12, 2017

Related U.S. Application Data

(60) Provisional application No. 62/320,785, filed on Apr. 11, 2016.

(51) Int. Cl.

| | |
|---|---|
| ***A45F 5/04*** | (2006.01) |
| ***A45F 5/00*** | (2006.01) |
| ***B65H 75/48*** | (2006.01) |

(52) U.S. Cl.

CPC ..... *A45F 5/004* (2013.01); *B65H 75/486* (2013.01); *A45F 5/04* (2013.01); *A45F 2005/008* (2013.01); *Y10S 224/932* (2013.01)

(58) Field of Classification Search

CPC .. A45F 5/04; A45F 5/004; A45F 5/021; A45F 2005/008; A63B 57/60; A63B 55/408; A63B 2047/043

USPC ..... 224/162, 904, 932; D6/608

See application file for complete search history.

(56) References Cited

U.S. PATENT DOCUMENTS

| | | | | |
|---|---|---|---|---|
| 3,755,858 A * | 9/1973 | McPhaul | A47K 10/12 | 224/932 |
| 3,760,461 A * | 9/1973 | Wright | A41D 13/0015 | 15/209.1 |
| 4,957,232 A * | 9/1990 | Sprague | A45F 5/02 | 224/249 |
| 5,318,292 A | 6/1994 | De Marco | | |
| 5,419,477 A * | 5/1995 | Verge | A47K 10/025 | 15/208 |
| 5,553,345 A | 9/1996 | Bell | | |
| 5,564,166 A | 10/1996 | Roy | | |

(Continued)

OTHER PUBLICATIONS https://www.amazon.com/Agree-RG918-Towele-Retractable-Velcro/dp/B0013KZIJ4, "Argee RG918 Le Towele Retractable Towel with Clip and Velcro Belt, Black".

(Continued)

*Primary Examiner* — Justin Larson

(74) *Attorney, Agent, or Firm* — Robert J. Lauson, Esq.; Lauson & Tarver LLP

(57) ABSTRACT

A retractable fitness towel holder includes an elongated flexible band for looping around a user's arm. A frame disposed on the band is held against the user's arm with a loop portion extending away from the user's arm. A retracting mechanism is biased to retract a cord coupled to the towel, and the towel is retractably suspended from the towel channel such that it extends through the loop portion and away from the holder. Pulling the towel through the loop portion and away from the frame, causes the cord to unspool from the retracting mechanism, and releasing the towel causes the retracting mechanism to re-spool the cord, thereby drawing the towel back through the loop portion to rest against the frame, holding the towel in place during exercise.

20 Claims, 4 Drawing Sheets

(56) References Cited

U.S. PATENT DOCUMENTS

| | | | | | |
|---|---|---|---|---|---|
| D378,483 | S * | 3/1997 | Kiefer | D6/608 | |
| 5,671,515 | A | 9/1997 | Evans | | |
| 5,902,661 | A * | 5/1999 | Oster | A47K 10/02 | 428/82 |
| 6,256,840 | B1 | 7/2001 | Elliott | | |
| 6,881,273 | B1 * | 4/2005 | Oberman | A45F 5/004 | 134/6 |
| 7,152,279 | B2 | 12/2006 | Elliott | | |
| 8,276,235 | B2 * | 10/2012 | Naughton | A45F 5/02 | 15/118 |
| 9,038,869 | B2 * | 5/2015 | Moreau | A45F 5/02 | 224/162 |
| 2002/0000455 | A1 * | 1/2002 | Condliff | A45F 5/004 | 224/162 |
| 2005/0258203 | A1 * | 11/2005 | Weaver | A45F 5/004 | 224/162 |
| 2009/0209369 | A1 * | 8/2009 | Smith | A63B 57/207 | 473/406 |
| 2017/0119139 | A1 * | 5/2017 | Findlay | A45F 5/021 | |
| 2017/0290409 | A1 * | 10/2017 | Terry | A45F 5/004 | |

OTHER PUBLICATIONS https://www.amazon.com/Mully-Golf-Towel-Original-Retractable/dp/B00B9DN5K4/, "The Mully Golf Towel—The Original Retractable Golf Towel (Various Colors)".

https://www.themullytowel.com "Fishing | The Mully(R) Retractable Sports Towel, Clips On and Stays Out of the Way".

http://news.health.com/2009/07/30/gear-guide-competitowel-retractable-clip-on-exercise-towel/, "Gear Guide: CompetiTowel Retractable Clip-On Exercise Towel".

* cited by examiner

RETRACTABLE FITNESS TOWEL AND HOLDER

This application claims the benefit of the filing date of provisional application No. 62/320,785, filed on Apr. 11, 2016.

BACKGROUND

Towels, sweatbands, and similar cloth-like apparatus (collectively 'towels') are commonly used in gymnasium settings and fitness facilities, both during and after exercise. Towels are generally necessary for removing perspiration from the person of a user, or residual perspiration left on equipment after use, as a courtesy to the next user. In busy fitness facilities, towels are also frequently necessary for cleaning equipment prior to use. Because towels are not attached to the user or user's clothing, they are prone to loss and unintentional soiling when set on an unclean surface. Once forgotten or lost, users must use a hand or arm to wipe off equipment, which is unsanitary and frequently inadequate.

Many products have been developed in an attempt to solve the problem of keeping a towel handy during an exercise routine. User's commonly wrap a towel around the user's hand or wrist, but this process is undesirable since the it provides insufficient surface area to absorb adequate sweat during a workout, and may present a hazard due to being cumbersome and interfering with the user's movement and grip.

Some products have been developed using a clip or similar attachment mechanism to affix the towel to the user's shirt or waistline. These mechanisms are disfavored because they adversely impact a user's workout clothing, and often fail, thus allowing a towel to become soiled when it falls to the floor. Other mechanisms include extendable retracting mechanisms used in connection with a clip. These are also disfavored, since the location used to attach the towel makes them uncomfortable, non-ergonomic, and leaves the towel free to swing about, thus presenting a hazardous condition as a user's body moves through an exercise Thus there is a need for a towel and towel holder that stays with a person during exercise to avoid loss of the towel. There is also a need for a towel holder that prevents a towel from becoming soiled or dirtied while a person is exercising. There is also a need for a towel holder that holds a towel in a conveniently reached, yet out of the way place during exercise. There is also a need for a towel holder that automatically secures the towel out of the way when a person is temporarily finished using the towel.

SUMMARY

A fitness towel holder for installation on a user's arm includes a flexible band releasably looping the user's arm. Optionally, a closure may be included to secure the flexible band on the user's arm. A frame having a projecting loop portion extends away from the user's arm. The frame, other than the loop portion, is preferably partially coplanar with the user's arm. A retracting mechanism is disposed proximate the frame and is spaced apart from the loop portion. The retracting mechanism is biased to spool a cord through the loop portion, the cord ending in a towel clasp. The towel clasp is preferably configured to affix to the towel and the retracting mechanism is spaced apart from the loop portion such that the towel clasp pulls the towel partially through the loop portion.

The flexible band may include cutouts for adjustably looping the flexible band around the user's arm. Preferably, the closure is a hook and loop or similarly easily engaging and disengaging fastening material. The cord may pass through a cord hole, with the cord hole disposed above the retracting mechanism when the holder is worn on the user's arm. Preferably approximately two thirds of the towel extends through the loop portion when the retracting mechanism is in its biased position, and approximately one third of the towel extends from the holder when the retracting mechanism is in its biased position. The holder may include a small pocket, with a pocket opening bounded by the frame. The pocket may also be disposed between the retracting mechanism and the loop portion.

In a second embodiment, the holder and fitness towel comprises an elongated flexible band having a closure for fixedly looping the band around the user's arm. A frame disposed along the length of the flexible band is held against the user's arm by the flexible band, and a loop portion extends away from the user's arm. A retracting mechanism is held in place between the frame and the flexible band. The retracting mechanism is biased to retract a cord extending from the retracting mechanism, with the cord coupled to the towel. The towel is retractably suspended from the frame, extending through the loop portion and away from the frame. Pulling the towel through the loop portion and away from the frame, causes the cord to unspool from the retracting mechanism, and releasing the towel causes the retracting mechanism to re-spool the cord, thereby drawing the towel back through the loop portion to rest against the frame.

In this embodiment the flexible band may comprise multiple cutouts for adjustably looping the flexible band around the user's arm. The closure also preferably comprises hook and loop fastening material. The cord passes through a cord hole, with the cord hole disposed above the retracting mechanism when the holder is installed on the user's arm. A towel clasp connects the cord to the towel. When the retracting mechanism is retracted, approximately two thirds of the towel is held against the frame, and approximately one third of the towel extends from the holder. A small pocket is bounded by the frame, and may be located between the retracting mechanism and the loop portion.

In a third embodiment, a retractable fitness towel and holder for fixation on a user's arm includes a frame forming a loop portion extending away from an elongated flexible band, the flexible band having a releasable closure for fixing the flexible band on the user's arm. A retracting mechanism on the frame is biased to spool a cord coupled to the towel. The towel is disengaged from the loop portion when the cord is unspooled, and the loop portion confines the towel when the cord is spooled, such that approximately two thirds of the towel is disposed along the frame and approximately one third of the towel extends away from the holder. Preferably, the cord extends through a cord hole and the retracting mechanism is located between the cord hole and the loop portion on the frame. A small pocket may be located between the retracting mechanism and the loop portion.

DESCRIPTION

Figure 1:
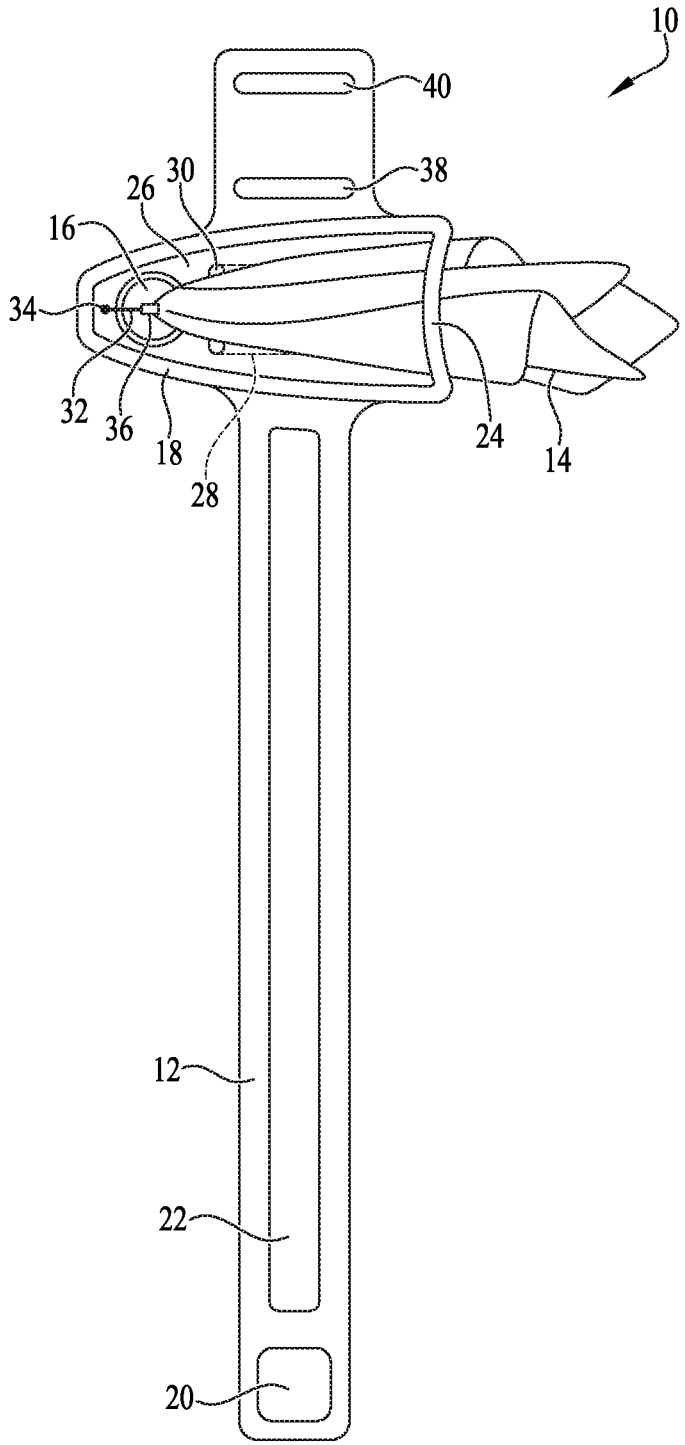
FIG. 1 illustrates a front view of a fixed extendable fitness towel and holder.

Referring to FIG. 1. A retractable fitness towel and holder apparatus ('holder') 10 comprises a flexible band 12, a towel 14, a retracting mechanism 16, and a frame 18. The flexible band 12 in its preferred embodiment comprises a small patch of hook material 20 and a long strip of loop material 22 extending from the hook material 20 to the frame 18, the hook material 20 and the loop material 22 together forming a conventional hook-and-loop fastener (20, 22) commonly known in the art. The towel 14 is preferably a super absorbent fabric towel 14, although any variety of absorptive, cloth-like, towel-like item is contemplated. Optionally, the towel 14 may be omitted from the holder 10 as manufactured and sold, with a user securing a preferred towel 14 and affixing it to the holder 10 prior to use.

The frame 18 preferably extends up and over the top two thirds of the towel 14 when the holder 10 is worn by a user, preventing most of the towel 14 from touching the user's arm (not shown) when installed thereon. The frame 18 includes a loop portion 24, which loops over the towel 14, restraining it, but preferably allowing approximately the bottom third of the towel 14 to extend below the holder 10 when worn by the user. The frame 18, including the loop portion 24 is preferably made of a material more rigid than the flexible band 12, such as plastic or a stiff fabric.

Underlying the non-looped portion of the frame 18 and sandwiched between the towel 14 and the flexible band 12 there is a layer of stretch material 26 bordered by the frame 18, excluding the loop portion 24. This stretch material 26 may be affixed to both the frame 18 and the flexible band 12, and forms a small pocket 28 with a pocket opening 30 located behind the towel 14 when the towel 14 is retracted through the loop portion 24.

The retracting mechanism 16 is located above the pocket 28, affixed relative to the frame 18 and the flexible band 12. Extending upward from the retracting mechanism 16 is a cord 32 threaded through a cord hole 34 and attached to a towel clasp 36. The towel clasp 36 is removably attached to the towel 14, allowing the towel 14 to be removed from the holder 10 for periodic laundering, and reinstallation.

A first cutout 38 and a second cutout 40 are provided on the flexible band 12 and are located opposite the hook material 20 and loop material 22 with the towel 14, frame 18 and related structures located between them. The cutouts 38, 40 allow the flexible band 12 to be wrapped around a user's arm, preferably the user's bicep, threaded through the cutouts 38, 40, and looped back in the opposite direction. The flexible band 12 can then be manipulated such that the hook material 20 faces and comes into contact with the loop material 22, thereby fastening the flexible band 12 in place on the user's bicep. By providing two cutouts 38, 40, in concert with the elongated loop material 22 on the flexible band 12, the holder 10 can be used on a wide variety of biceps, both large and small.

Figure 2:
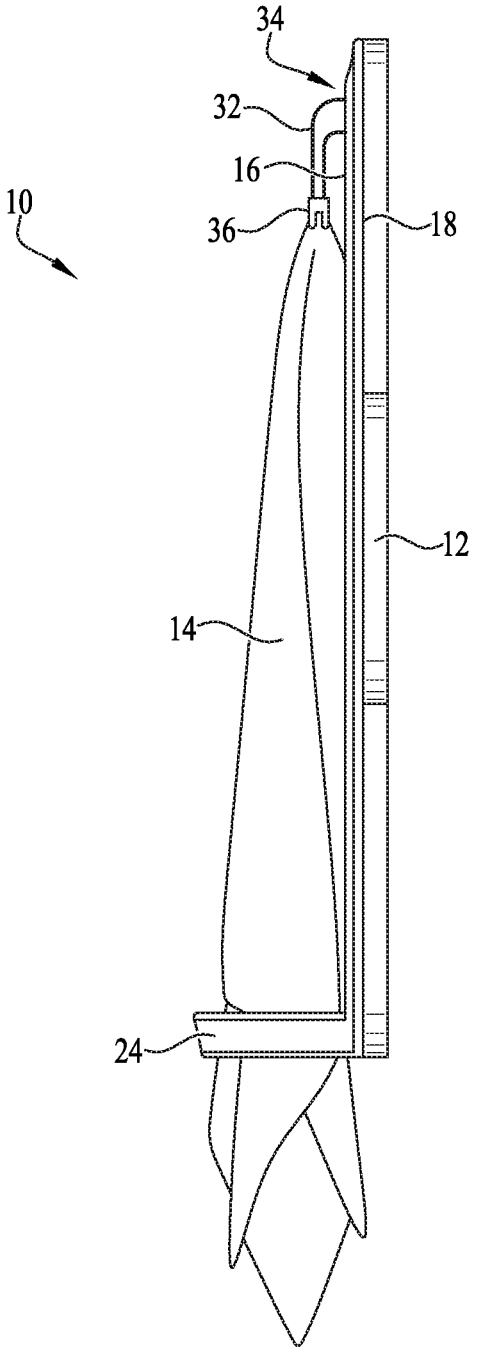
FIG. 2 illustrates a side view of the fitness towel and holder.

Referring lo FIG. 2 the frame 18 is shown in profile, illustrating loop portion 24. Thus the frame 18 extends up and over the towel 14 along a user's bicep, while also looping outward around the towel 14 to hold the towel 14 in position. By looping around the towel 14, and in concert with the towel clasp 36, the frame 18 holds the towel 14 in position as a user moves during exercise. Preferably, when fully retracted, approximately two thirds of the towel 14 is located adjacent or approximately adjacent to the frame 18 (and stretch material 26), while a third of the towel 14 extends below he looped portion 24, away from the holder 10, thereby making the towel 14 easily accessible to the user.

Figure 3:
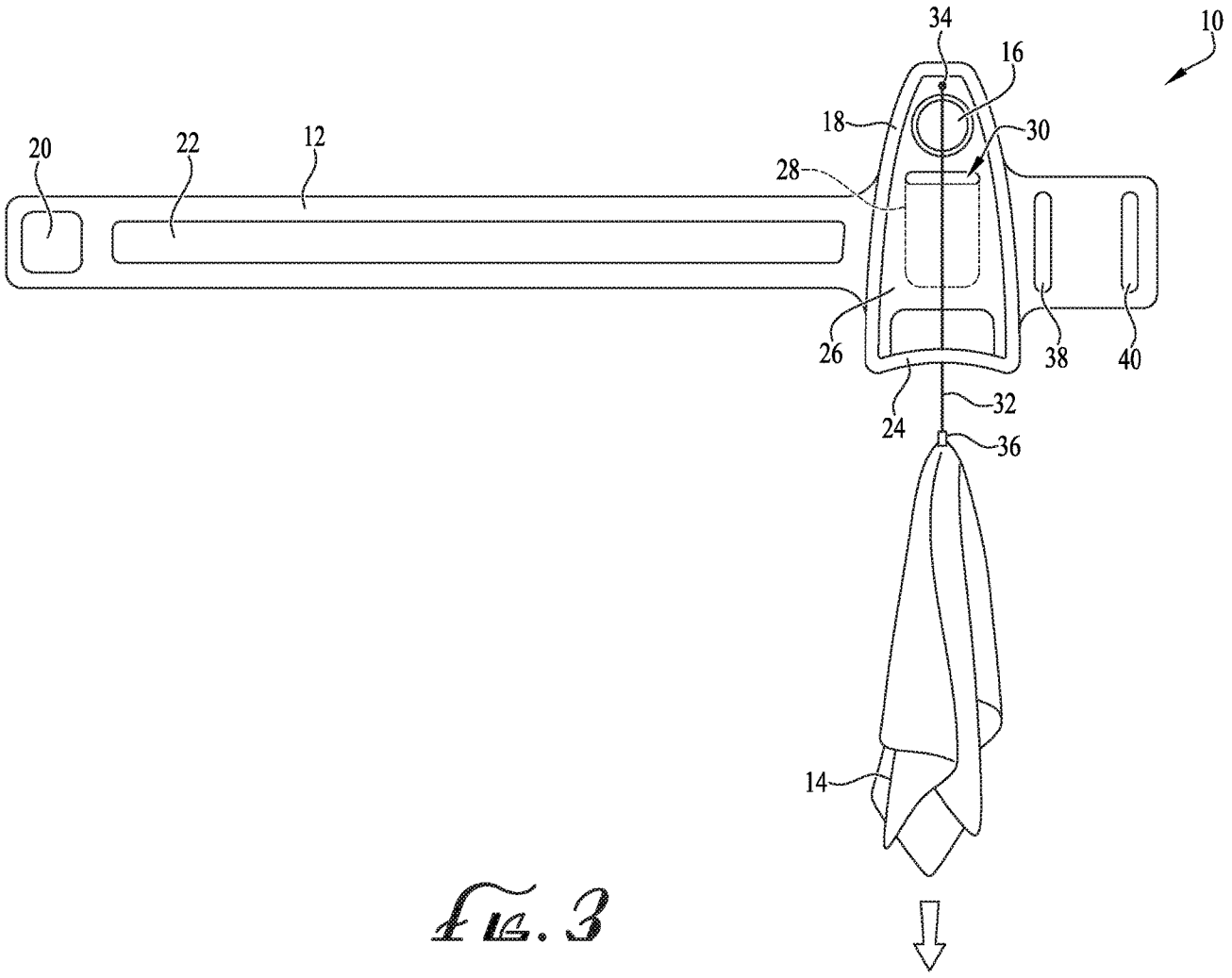
FIG. 3 illustrates a front view of the fitness towel and holder, with the towel portion extended downward.

Referring to FIG. 3, the towel 14 is shown extended from its fully rets acted position away from the frame 18, as would occur when a user grasps and uses the towel 14 during a workout. In this position, the cord 32 is extended out of the retracting mechanism 16 and can extend an appropriate length for a user to employ the towel 14. Because the towel 14 is pulled down and away from the frame 18 through the loop portion 24, the cord 32 remains between the frame 18 and the user's bicep. When the towel 14 is retracted, it travels under the loop portion 24 of the frame 18 so that the frame 18 and looped portion 24 is once again looped around a major portion of the towel 14.

Figure 4:
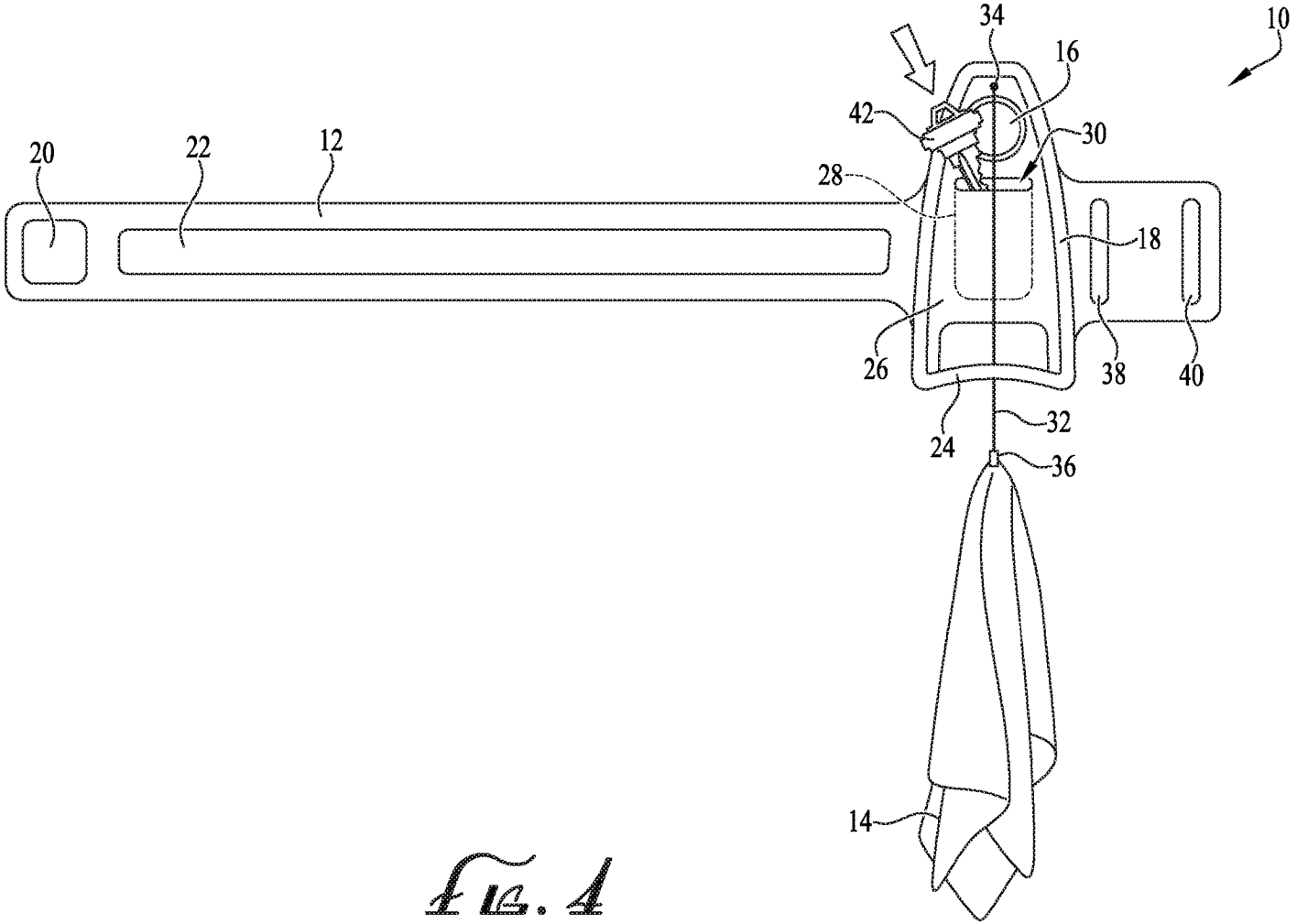
FIG. 4 illustrates a front view of the fitness towel and holder with the towel portion extended downward, and revealing a small storage pocket.

Referring to FIG. 4, when the towel 14 is extended, the small pocket 28 is accessible and more visible. The small pocket 28 is preferably sized to receive a small item 42, such as a key, and card-sized items, such as a credit card or drivers license. Preferably the stretch material 26 is manufactured with sufficient tension to cause the small pocket 28 to retain any small items 42 therein under sufficient pressure to preserve them in the small pocket 28 even during a workout. With the towel 14 in a retracted position covering the small pocket 28 the towel 14 provides extra protection against dislodging of the small items 42 when the towel 14 is retracted.

The structure of the holder 10 having been shown and described, its method of operation will now be discussed.

A user may first need to obtain a towel 14 and affix it to the towel clasp 36 as an assembly stage before putting on the holder 10 and fastening it before a workout. Once the towel 14 is affixed to the towel clasp 36, if necessary, the retracting mechanism 16 will reel in the cord 32, drawing the towel 14 up against the frame 18 with the loop portion 24 looped around the towel 14. The holder 10 may then be installed on the user's arm for use during the user's workout.

To install the holder 10, prior to a workout or at other predetermined time, the user may position the holder 10 on the user's arm, preferably on the outside of the user's bicep. The user then wraps the flexible band 12 around the bicep and inserts it through one of the cutouts 38, 40 according to preference and the size of the user's bicep. The flexible band 12 is then wrapped in a reverse direction around the user's bicep and the hook material 20 pressed into the loop material 22, thereby fixing the flexible band 12 (and by extension, the holder 10) on the user's bicep and ready for use.

The user may wish to insert one or more small items 42 such as a car key, credit card, or drivers license into the small pocket 28. This can be done prior to installing the towel 14, or after the towel 14 is affixed to the towel clasp 36 by pushing the towel 14 aside and inserting the small items 42 into the small pocket 28. Removing the small items 42 may be accomplished in the same manner.

With the holder 10 affixed to the user's bicep, and small items 42 stored in the pocket 28, the user may engage in a variety of fitness activities. During these activities, when sweat is produced, the user may wish to towel off the user's person or fitness equipment. To do so, the user simply pulls down on the towel 14, using it as desired, most commonly to absorb perspiration as one would use a conventional towel. When the user pulls down on the towel 14, the towel clasp 36 accompanies it, pulling the cord 32 out of the retracting mechanism 16. The cord 32 extends out of the retracting mechanism 16 up and through the cord hole 34, then down through the loop portion 24 of the frame 18, connecting it to the towel clasp 36.

After the towel 14 is used, the user simply releases the towel 14, allowing the retracting mechanism 16 to pull the cord 32 (and by extension, the towel 14) back into the frame 18. The towel 14 will remain retracted until needed again, and the process can be repeated as many times as necessary during the user's workout session.

When the workout session is over, the user simply peels the hook material 20 away from the loop material 22, and pulls the flexible band 12 through one of the cutouts 38, 40, allowing the holder 10 to be removed from the user's bicep and stored for future use. Optionally, the towel 14 may be removed from the towel clasp 36 and laundered as necessary before reinstallation.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A holder of a fitness towel for installation on a user's arm, the holder comprising:

a flexible band releasably looping the user's arm;

a frame coupled to the flexible band, the frame having a projecting loop portion extending away from the user's arm;

a retracting mechanism disposed proximate the frame, the retracting mechanism biased to retractably spool a cord, the cord extending through the loop portion and ending in a towel clasp; and wherein the towel clasp is affixed to the fitness towel, and the retracting mechanism is sufficiently spaced apart from the loop portion such that the retracting mechanism pulls the fitness towel through the loop portion.

2. The apparatus of claim 1 wherein the flexible band comprises a plurality of cutouts for adjustably securing the flexible band around the user's arm.

3. The apparatus of claim 1 wherein the flexible band comprises hook and loop fastening material.

4. The apparatus of claim 1 wherein the cord passes through a cord hole, the cord hole disposed above the retracting mechanism when the holder is worn on the user's arm.

5. The apparatus of claim 1 wherein the retracting mechanism pulls approximately two thirds of the fitness towel through the loop portion.

6. The apparatus of claim 1 wherein the retracting mechanism pulls approximately one third of the fitness towel through the loop portion.

7. The apparatus of claim 1 further comprising a pocket in the frame.

8. The apparatus of claim 1 further comprising a pocket disposed between the retracting mechanism and the loop portion.

9. A holder and fitness towel for a user's arm, the holder and fitness towel comprising:

an elongated flexible band having a closure for releasably looping the elongated flexible band around the user's arm;

a frame disposed along the length of the elongated flexible band, the frame held against the user's arm by the elongated flexible band, and further comprising a loop portion extending away from the user's arm;

a retracting mechanism held in place between the frame and the elongated flexible band, the retracting mechanism biased to retract a cord extending from the retracting mechanism, the cord coupled to the towel;

the fitness towel retractably suspended from the frame, the fitness towel extending through the loop portion and away from the frame;

wherein pulling the fitness towel through the loop portion and away from the frame, causes the cord to unspool from the retracting mechanism, and releasing the fitness towel causes the retracting mechanism to re-spool the cord, such that the fitness towel is drawn at least partially back through the loop portion to rest against the frame.

10. The apparatus of claim 9 wherein the flexible band comprises multiple cutouts for adjustably looping the flexible band around the user's arm.

11. The apparatus of claim 9 wherein the flexible band comprises hook and loop fastening material.

12. The apparatus of claim 9 wherein the cord passes through a cord hole, the cord hole disposed above the retracting mechanism when the holder is installed on the user's arm.

13. The apparatus of claim 9 further comprising a towel clasp connecting the cord to the towel.

14. The apparatus of claim 9 wherein approximately two thirds of the fitness towel is held against the frame when the retracting mechanism is retracted.

15. The apparatus of claim 9 wherein approximately one third of the fitness towel extends from the holder when the retracting mechanism is retracted.

16. The apparatus of claim 9 further comprising a pocket bounded by the frame.

17. The apparatus of claim 9 further comprising a pocket between retracting mechanism and the loop portion.

18. A holder of a retractable fitness towel for attachment on a user's arm, the holder comprising:

a frame forming a loop portion extending away from an elongated flexible band, the flexible band having a releasable closure for fixing the flexible band on the user's arm;

a retracting mechanism on the frame biased to spool a cord coupled to the fitness towel;

wherein the fitness towel is disengaged from the loop portion when the cord is unspooled; and wherein the loop portion confines the fitness towel when the cord is spooled, such that at least half of the fitness towel is captive along the frame.

19. The holder of claim 18 wherein the cord extends through a cord hole, the retracting mechanism located between the cord hole and the loop portion on the frame.

20. The holder of claim 18 further comprising a pocket between the retracting mechanism and the loop portion.

* * * * *